US008920058B2

(12) United States Patent
Simard et al.

(10) Patent No.: US 8,920,058 B2
(45) Date of Patent: Dec. 30, 2014

(54) PARTIALLY EXTENDABLE HAIR BRUSH

(75) Inventors: Marisol A. Simard, Upper Nyack, NY (US); Gregory A. Ornoski, Teaneck, NY (US)

(73) Assignee: Avon Products, Inc, New York, NY (US)

( * ) Notice: Subject to any disclaimer, the term of this patent is extended or adjusted under 35 U.S.C. 154(b) by 627 days.

(21) Appl. No.: 13/152,379

(22) Filed: Jun. 3, 2011

(65) Prior Publication Data

US 2011/0299913 A1 Dec. 8, 2011

Related U.S. Application Data

(60) Provisional application No. 61/351,364, filed on Jun. 4, 2010.

(51) Int. Cl.

| | |
|---|---|
| ***A46B 5/00*** | (2006.01) |
| ***A46B 9/00*** | (2006.01) |
| ***A46B 9/02*** | (2006.01) |
| ***A46B 7/02*** | (2006.01) |
| *A45D 40/26* | (2006.01) |

(52) U.S. Cl.

CPC ..... *A46B 9/023* (2013.01); *A46B 5/0054* (2013.01); *A46B 7/02* (2013.01); *A46B 9/005* (2013.01); *A46B 5/0041* (2013.01); *A46B 5/0058* (2013.01); *A45D 40/264* (2013.01); *A45D 40/265* (2013.01); *A46B 2200/104* (2013.01); *A46B 2200/1046* (2013.01); *A46B 2200/1053* (2013.01); *A46B 5/005* (2013.01)

USPC ..... 401/127; 401/129; 15/106; 132/218

(58) Field of Classification Search

USPC ..... 401/118, 121, 122, 123, 124, 125, 126, 401/127, 128, 129, 130; 15/106; 132/120, 132/218

See application file for complete search history.

(56) References Cited

U.S. PATENT DOCUMENTS

| | | | | |
|---|---|---|---|---|
| 1,905,399 | A * | 4/1933 | Wagner | 15/160 |
| 4,219,283 | A | 8/1980 | Buckley et al. | |
| 5,121,763 | A | 6/1992 | Kingsford | |
| 5,137,038 | A | 8/1992 | Kingsford | |
| 6,616,366 | B1 | 9/2003 | Weihrauch | |
| 7,473,046 | B2 * | 1/2009 | Kraus et al. | 401/117 |
| 2009/0071499 | A1 * | 3/2009 | Wyatt et al. | 132/218 |
| 2009/0276973 | A1 * | 11/2009 | Bouix et al. | 15/206 |
| 2010/0175708 | A1 * | 7/2010 | Kim | 132/218 |
| 2011/0135376 | A1 * | 6/2011 | Weigel et al. | 401/29 |
| 2011/0297173 | A1 * | 12/2011 | Anderson et al. | 132/218 |

FOREIGN PATENT DOCUMENTS

| | | | |
|---|---|---|---|
| EP | 2266434 | A1 | 12/2010 |
| FR | 2701197 | A1 | 8/1994 |

* cited by examiner

*Primary Examiner* — David Walczak
*Assistant Examiner* — Joshua Wiljanen
(74) *Attorney, Agent, or Firm* — David M. Joyal; Joan M. McGillycuddy

(57) ABSTRACT

A grooming device comprising a grooming element. The grooming element may be elongated along a longitudinal axis. The grooming device has a first portion and a second portion separateable from the first portion and capable of moving independently from the first portion along the longitudinal axis. The first and/or second portions of the grooming element include means engaging keratin fibers or for improving the aesthetic appearance of keratin fibers.

16 Claims, 8 Drawing Sheets

PARTIALLY EXTENDABLE HAIR BRUSH

CROSS REFERENCE TO RELATED APPLICATIONS

This application claims priority benefit, under 35 U.S.C. §119(e), of U.S. Provisional Patent Application No. 61/351,364, filed Jun. 4, 2010, the contents of which application are hereby incorporated by reference in their entirety.

FIELD OF INVENTION

The present invention relates generally to grooming devices. More particularly, the present invention relates to devices for grooming keratin fibers and for applying a hair care composition to the hair, particularly hair of the scalp.

BACKGROUND OF THE INVENTION

Conventional grooming devices generally include a brush having a single functionality. A regular or big size brush, while being generally capable of imparting a single grooming effect, lacks the ability to provide more than one grooming functionality. Therefore, to improve the ability to impart multiple grooming functionalities to keratin fibers, a user must carry a variety of brushes.

It is thus desirable to reduce the number of items needed by the user and provide a single grooming device having multiple parts capable of imparting different, beneficial grooming functionalities.

SUMMARY OF THE INVENTION

The present invention overcomes deficiencies of prior hair brushes, combs, and like grooming implements by providing two or more functionalities in a single device. The grooming device of the invention will typically, but not necessarily, have the appearance of hair brush, and in particular the type of hair brush having an elongated cylindrical body with bristles or tines extending outward from its surface. The device will typically comprise a handle for holding it in the user's hand, which may, but not necessarily, take the form of the handle of a conventional hair brush. The device will include a grooming element which is composed of two or more distinct portions that are capable of moving independently from one another, such that the overall functionality of the device is altered when the first and second portions are separated, partially or completely, from one another. In some, but not all embodiments, at least one of the portions of the grooming elements has the functionality of a hair brush.

The grooming element includes a first portion and a second portion separatable from the first portion. The first and second portions may be capable of moving independently from one another. The grooming element may be elongated along a longitudinal axis. The second portion may also be capable of moving independently from the first portion along the longitudinal axis. In certain embodiments, the grooming element may have a substantially cylindrical, rectangular, obloid, conical, spherical, prismatic, or lemniscoid shape. The first portion of the grooming element may include a cut-away therein suitably shaped to receive the second portion of the grooming element. Preferably, the first and second portions together form a substantially uniform cross-sectional profile of the grooming element.

The first and/or second portion of the grooming element may have a textured or smooth surface for engaging keratin fibers or for improving the aesthetic appearance of keratin fibers. The textured or smooth surface may also be capable of holding a charge of hair care composition and transferring it to an integument (e.g., hair of the scalp) on contact therewith. The textured surface may comprise bristles, projections, indentations, fins, tines, velcro, teeth, grooves, sponges, foam and flocked surfaces. Preferably, the first portion of the grooming element has a textured surface composed of a plurality of bristles or tines extending from the surface of the grooming element.

In certain embodiments, the second portion of the grooming element comprises at least a portion of the terminal end of the grooming element. Alternatively, the second portion of the grooming element comprises the entire terminal end of the grooming element. In another embodiment, the second portion of the grooming element is coaxial with the first portion of the grooming element.

In some embodiments, a handle is fixed to the first portion of the grooming element such that the first portion cannot move in a longitudinal direction with respect to the handle. In an alternative embodiment, the second portion cannot move in a longitudinal direction with respect to the handle. An actuating mechanism may be disposed on or in the handle portion for moving said mobile portion along the longitudinal axis.

The grooming device may be used to apply a hair care composition to the hair. The device may be used to apply any off-the-shelf hair care composition, or it may be included together with a container of hair care composition. In some embodiments, the grooming device is included as part of a system including a container of hair care composition, for example, styling gel, mousse, hair colorant, or the like. In one embodiment, the system includes the grooming device and a container holding a hair care composition, where the handle of the grooming device includes a fastening means that is capable of reversibly securing the device to the container such that the grooming element is disposed inside the container through an opening of the container when the device is affixed to the container and such that the opening in the container is sealed by the device. The fastening means may include a cap affixed to the device which is capable of closing the container. The cap may be threaded, for example, such that it can be screwed onto a complementary threading on the container, or the cap may form a press-fit closure with the container. In some embodiments, the device can be secured to the container directly, without a cap. For example, the device may include a threaded portion that screws into a complementary threaded portion on the opening of the container, or may press-fit into the opening of the container, or may have any complementary shape that mates with the opening of the container to seal it while the grooming element is within the container.

In another embodiment, a grooming device includes a first grooming element elongated along a longitudinal axis, and a second grooming element disposed within and coaxial to the first grooming element. The outer surfaces of the first and second grooming elements are separatable from one another and capable of moving independently from one another along the longitudinal axis. The second grooming element may be capable of moving independently from the first grooming element along the longitudinal axis. In certain embodiments, the second grooming element includes a comb or a brush, which retracts into said first grooming element when said second grooming element is in a fully retracted position. In other embodiments, the second grooming element includes a comb or a brush, which is in contact with at least one outer surface of said first grooming element when said second grooming element is in a fully retracted position.

A hair care product including the grooming device of the present invention and a container charged with a hair care composition to which a cap is capable of being reversibly secured. The container may be configured to receive the grooming element when inserted into the container. A wiper may be attached to the container for removing excess hair care composition from the first portion and/or the second portion of the grooming element upon removal of the grooming device from the reservoir. The wiper may be dimensioned to remove the hair care composition from the first and second grooming element portions when the grooming device is removed from the container. In certain embodiments, the wiper includes a constriction in the opening of the container, which may be annular or any other shaped opening that generally matches the cross-section of the grooming device.

These and other aspects of the invention will become apparent to those skilled in the art after a reading of the following detailed description of the invention, including the figures and appended claims.

DETAILED DESCRIPTION

The inventive grooming device includes at least two portions that articulate along a common axis. These portions provide different functionalities to improve application of a hair care composition or to impart an aesthetically pleasing grooming effect, without the need for a user to carry and use separate and distinct devices. For example, a hair brush according to the present invention may include a brush portion for grooming of the hair as well as a comb portion for separating the hairs of the scalp. Such multi-functional devices of the present invention are compact and portable and provide a single convenience device for the user's hair care application and/or grooming needs.

The inventive grooming device generally includes an elongated grooming element having at least two portions. The grooming elements are suitable for applying a hair care composition to an integument or to any keratin fibers and may also be suitable for imparting a grooming effect to further improve the aesthetic appearance of the integument or keratin fibers. Specifically, the grooming device according to the invention may include elements suitable for different functionalities so as to improve application of a hair care composition and/or to impart different grooming effects. The grooming device according to the invention may also be useful for application of a variety of hair care and personal care products to keratin fibers or to the skin, including without limitation, hair dye, hair gel, mousse, conditioner, hair serum, etc. In particular, the grooming device according to the invention is useful for application of a hair care composition to the hair of the scalp, including without limitation, pigmented hair dyes, pharmaceutically and/or cosmeceutically active hair care compositions, or a combination thereof. The device according to the invention may be useful for combing, brushing and/or styling keratin fibers. As used herein, the term "keratin fibers" may include, without limitation, hair of the scalp, or any other part of the body.

Figure 1:
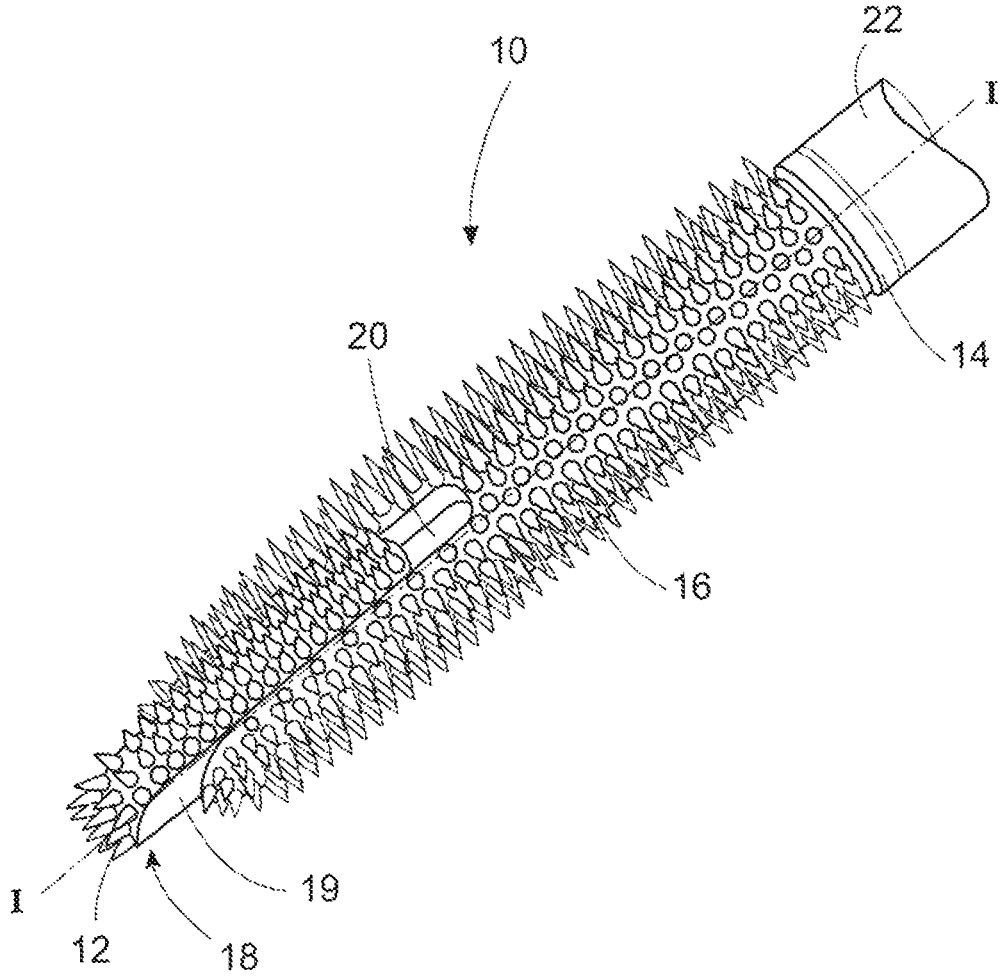
FIG. 1 shows an exemplary embodiment of the grooming device according to the present invention having a portion along a longitudinal axis and has a width extending from an exterior surface to the longitudinal axis that is capable of independently moving along the longitudinal axis.

Some of the currently preferred embodiments of the grooming device according to the invention are shown in FIGS. 1-5. The grooming device includes an grooming element 10 having a proximal end 14 and a distal end 12. The grooming element 10 may have at least two portions, a first portion 16 and a second portion 18 separable from the first portion 16. The second portion 18 may be capable of moving along the longitudinal axis I-I of the grooming element 10, independent from the first portion 16. Preferably, the second portion 18 comprises at least a portion of a distal end 12 of the grooming element 10. In some embodiments, the first portion 16 is coaxial with the second portion 18 of the grooming element 10. The second portion 18 may extend away from the first portion 16 in a distal direction of the grooming element 10 and retract towards the first portion 16 of the grooming element 10 in a proximal direction. Alternatively, the first portion 16 may extend away from the second portion 18 in a proximal direction and retract towards the second portion 18 in a distal direction. In a particular embodiment, the first portion 16 and the second portion 18 of the grooming element 10 may be fitted together to provide an grooming element 10 having a substantially uniform shape. Preferably, the first portion 16 and the second portion 18 may be fitted together to provide a substantially uniform cross-sectional profile. In certain embodiments, the first portion 16 has a cut-away 20 therein suitably shaped to received the second portion 18 of the grooming element 10, when the portions are brought together. For example, the second portion 18 may be capable of extending away from the first portion 16 in a distal direction and also capable of retracting to fit within the cut-away 20 by moving along the longitudinal axis I-I in a proximal direction. In certain embodiments, the cut-away 20 may be in a beveled and/or tapered shape for eliminating and/or scraping excess hair care composition from the surfaces 19 of the second portion 18 of the grooming element 10. The surfaces 19 are on the exterior of the second portion 18 but are hidden from view in the interior of grooming element 10 when the second portion 18 is fully retracted. In FIG. 1, it will be understood that the second portion 18 refers to the entire piece that extends and retracts, including the outer surface, whereas 19 refers only to the indicated surface which, in the embodiment of FIG. 1, is hidden from view when the second portion 18 is fully retracted, and may be partially or completely visible when second portion 18 is extended.

In addition, the grooming element 10 may be attached to any suitable handle 22 that permits the user to hold and manipulate the grooming device with the hand or fingers. In particular, the size and shape of the handle 22 permits the user to hold the handle 22 within the palm of the hand and manipulate the grooming device for grooming keratin fibers, imparting an aesthetically pleasing effect to the hair of the scalp or any other part of the body, or applying a hair care composition to keratin fibers.

In certain embodiments, the handle 22 may be fixably attached to the first portion 16 of the grooming element 10, wherein the first portion 16 cannot move in a longitudinal direction with respect to the handle 22 and the second portion 18 may be capable of moving along the longitudinal axis I-I independent from the handle 22. In other embodiments, the handle 22 may be fixably attached to the second portion 18 of the grooming element 10, wherein the second portion 18 cannot move in a longitudinal direction with respect to the handle 22 and the first portion 16 may be capable of moving along the longitudinal axis I-I independent from the handle 22.

The handle 22 may also include an actuating mechanism 23 disposed on or in the handle for moving either a first portion 16 or a second portion 18 of the grooming element 10 along the longitudinal axis I-I. Specifically, if the handle 22 is attached to the first portion 16 of the grooming element 10 such that the first portion 16 cannot move in a longitudinal direction with respect to the handle 22, then the actuating mechanism 23 is capable of moving the second portion 18 along the longitudinal axis I-I. In contrast, if the handle 22 is attached to the second portion 18 of the grooming element 10 such that the second portion 18 cannot move in a longitudinal direction with respect to the handle 22, then the actuating mechanism is capable of moving the first portion 16 along the longitudinal axis I-I. The actuating mechanism 23 may include any suitable mechanism known in the art, including, for example, a push button, a trigger, a lever, a twist dial, etc. The actuating mechanism 23 may be attached to a spring assembly or to a manual control that allows the user to advance or retract the independently movable portion of the grooming element 10, all at once or in an incremental manner. In FIGS. 1-4, 6 and 7, the complete handle and actuating mechanisms are not shown, although each of these embodiments contemplate a handle attached to the grooming element 10 and an actuating mechanism for moving the first portion 16 and/or the second portion 18 of the grooming element 10.

The grooming element 10 may have any suitable shape. The first portion 16 and the second portion 18 may be fitted together to form any substantially continuous curvilinear shape. Moreover, the first portion 16 and the second portion 18 of the grooming element 10 may be fitted together to have the shape of any conventional hair brush, such as a cylindrically shaped hair brush. Specifically, the grooming element 10 may be elongated or curved/bent. In particular, the grooming element 10 may have a cross-section across the longitudinal axis I-I of the grooming element 10 having the shape of an enclosed curve or a polygon, for example, a circle, oval, ellipse, triangle, square, rectangle, pentagon, hexagon, octagon, star polygon, etc. Preferably, the grooming element 10 may have a substantially cylindrical, rectangular, obloid, conical, spherical, prismatic, or lemniscoid (e.g., peanut-shaped) shape along the longitudinal axis I-I.

FIG. 1 shows a specific embodiment of the grooming device according to the present invention. The grooming element 10 as shown in FIG. 1 has a substantially cylindrical shape having a first portion 16 having a cut-away 20 parallel to the longitudinal axis I-I, the cut-away 20 being suitable for receiving a second portion 18 of the grooming element 10. The cut-away 20 may be symmetrical or asymmetrical. As shown in FIG. 1, the cut-away 20 may create one groove on the surface of the first portion 16 of the grooming element 10. Alternatively, the cut-away 20 may create two grooves on the surface of the first portion 16 of the grooming element 10. The cut-away 20 having a width extending from an exterior surface towards an interior portion of the grooming element 10. In the exemplary embodiment shown in FIG. 1, the cut-away 20 lies along the longitudinal axis I-I and has a width extending from an exterior surface to the longitudinal axis I-I. The second portion 18 of the grooming element 10 lies along the longitudinal axis I-I and comprises part of the distal end 12 of the grooming element 10. The first portion 16 and the second portion 18 may be fitted together to form a substantially cylindrical shape. In certain embodiments, the distal end 12 of the grooming element 10 may have a flat or angular shape. In other embodiments, the distal end 12 of the grooming element 10 may be rounded to form a curved shape. In the specific embodiment shown in FIG. 1, the distal end 12 of the grooming element 10 may be in the shape of a hemisphere, with the remainder of the grooming element 10 having a substantially cylindrical shape. However, it is contemplated that the distal end 12 of the grooming element 10 of the present invention may have any curvilinear shape.

Figure 2:
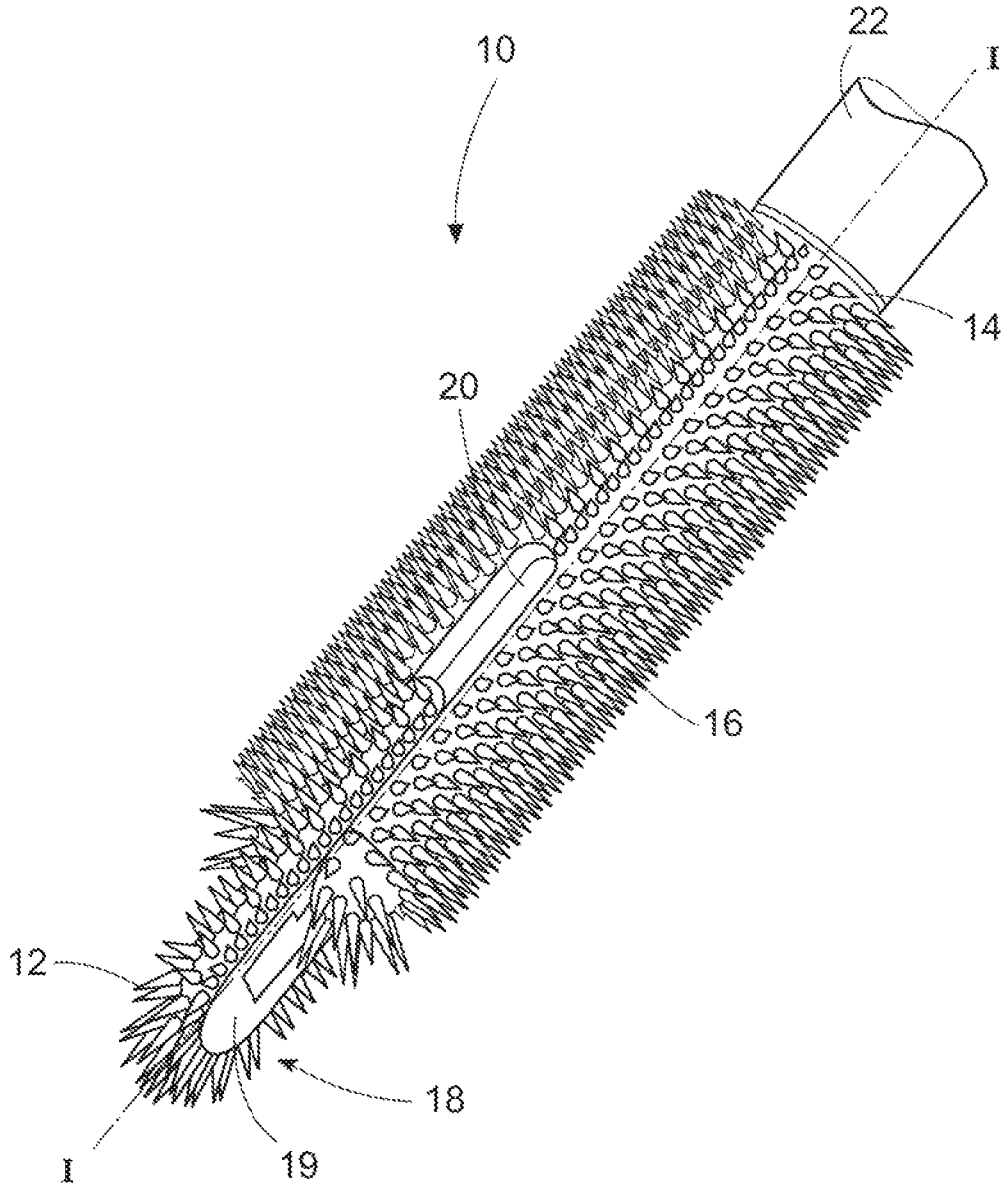
FIG. 2 shows an exemplary embodiment of the grooming device according to the present invention having a symmetrical portion along a longitudinal cross-section of the grooming device that is capable of independently moving along the longitudinal axis.

FIG. 2 shows another exemplary embodiment of the grooming device according to the present invention. Similar to the grooming device of FIG. 1, the grooming element 10 as shown in FIG. 2 also has a substantially cylindrical shape. The grooming element 10 includes a first portion 16 having a cut-away 20 parallel to the longitudinal axis I-I and along the longitudinal cross-section of the grooming device, the cut-away 20 being suitable for receiving a second portion 18 of the grooming element 10. In this particular embodiment, the second portion 18 of the grooming element 10 includes a central axis that is coaxial with the longitudinal axis I-I of the grooming element 10. As shown in FIG. 2, the cut-away 20 creates two grooves on the surface of the first portion 16 of the grooming element 10. In this particular embodiment, the second portion 18 of the grooming element 10 forms part of the distal end 12 of the grooming element 10, and lies along the longitudinal cross section of the grooming element 10 at the distal end 12 and optionally along at least some of the length of grooming element 10. Similar to the embodiment shown in FIG. 1, the first portion 16 and the second portion 18 of the grooming element 10 of the exemplary embodiment of FIG. 2 may be fitted together to form a substantially cylindrical shape.

Figure 3:
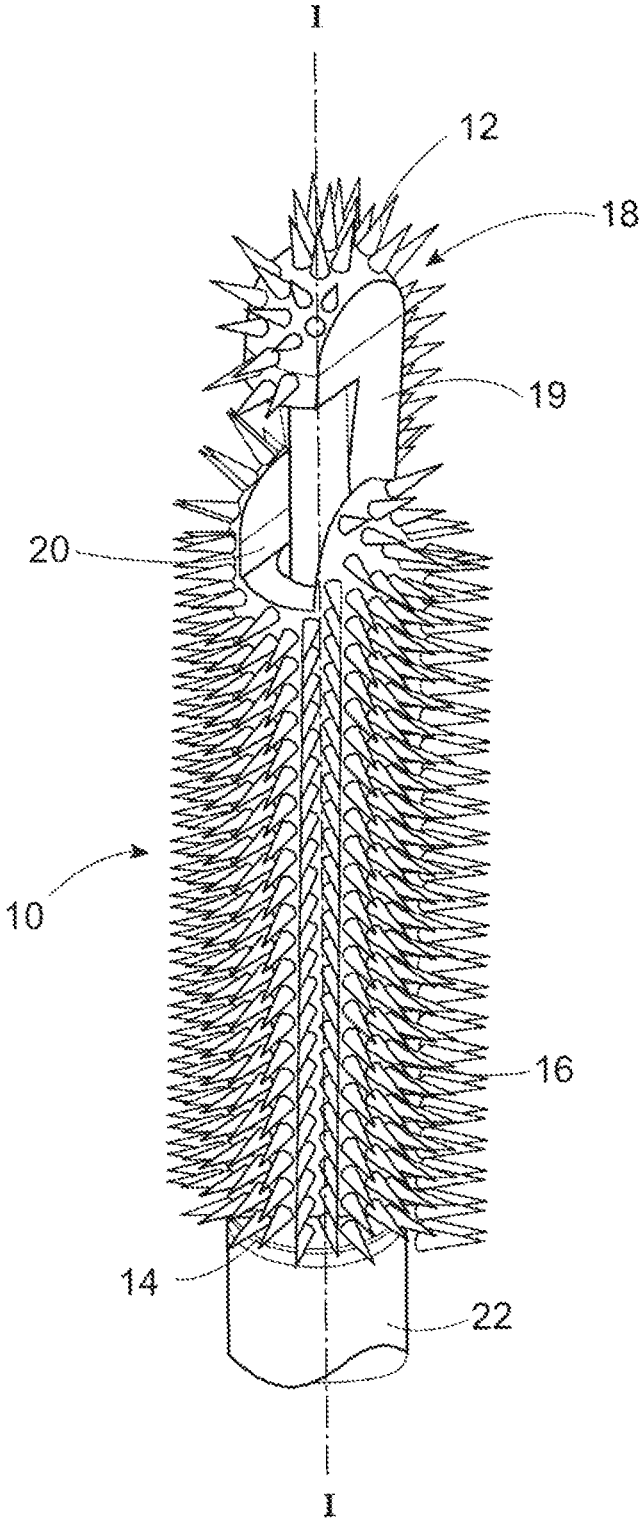
FIG. 3 shows an exemplary embodiment of the grooming device according to the present invention having an asymmetrical portion along a longitudinal cross-section at the distal end and a portion at the proximal end along a longitudinal axis and has a width extending from an exterior surface of the grooming device to the longitudinal axis that is capable of independently moving along the longitudinal axis.

FIG. 3 shows another exemplary embodiment of the grooming device according to the present invention. Similar to the grooming device of FIGS. 1 and 2, the grooming element 10 as shown in FIG. 3 also has a substantially cylindrical shape, but unlike FIG. 2, the cut-away 20 and second portion 18 are asymmetrically with respect to the opposing surfaces of the device. The grooming element 10 includes a first portion 16 having a cut-away 20 parallel to the longitudinal axis I-I, the cut-away 20 being suitable for receiving a second portion 18 of the grooming element 10. The second portion 18 of the grooming element 10 may have different cross sectional shapes along the longitudinal axis I-I. At the distal end 12 of the second portion 18, the second portion 18 lies along the longitudinal cross-section of the grooming element 10. However, towards the proximal end of the second portion 18, the second portion 18 becomes asymmetrical. As can be seen in FIG. 3, the proximal end of the second portion 18 lies along the longitudinal axis I-I and has a width extending from an exterior surface to the longitudinal axis I-I. It is contemplated that the size and shape of a cross-section of second portion 18 about the longitudinal axis I-I may change along different positions on the longitudinal axis I-I. A change from one cross-sectional size and shape may be gradual or may be in a discontinuous manner, which is shown in the exemplary embodiment of FIG. 3. Similar to the embodiments shown in FIGS. 1 and 2, the first portion 16 and the second portion 18 of the grooming element 10 of the exemplary embodiment of FIG. 3 may be fitted together to form a substantially cylindrical shape.

Figure 4:
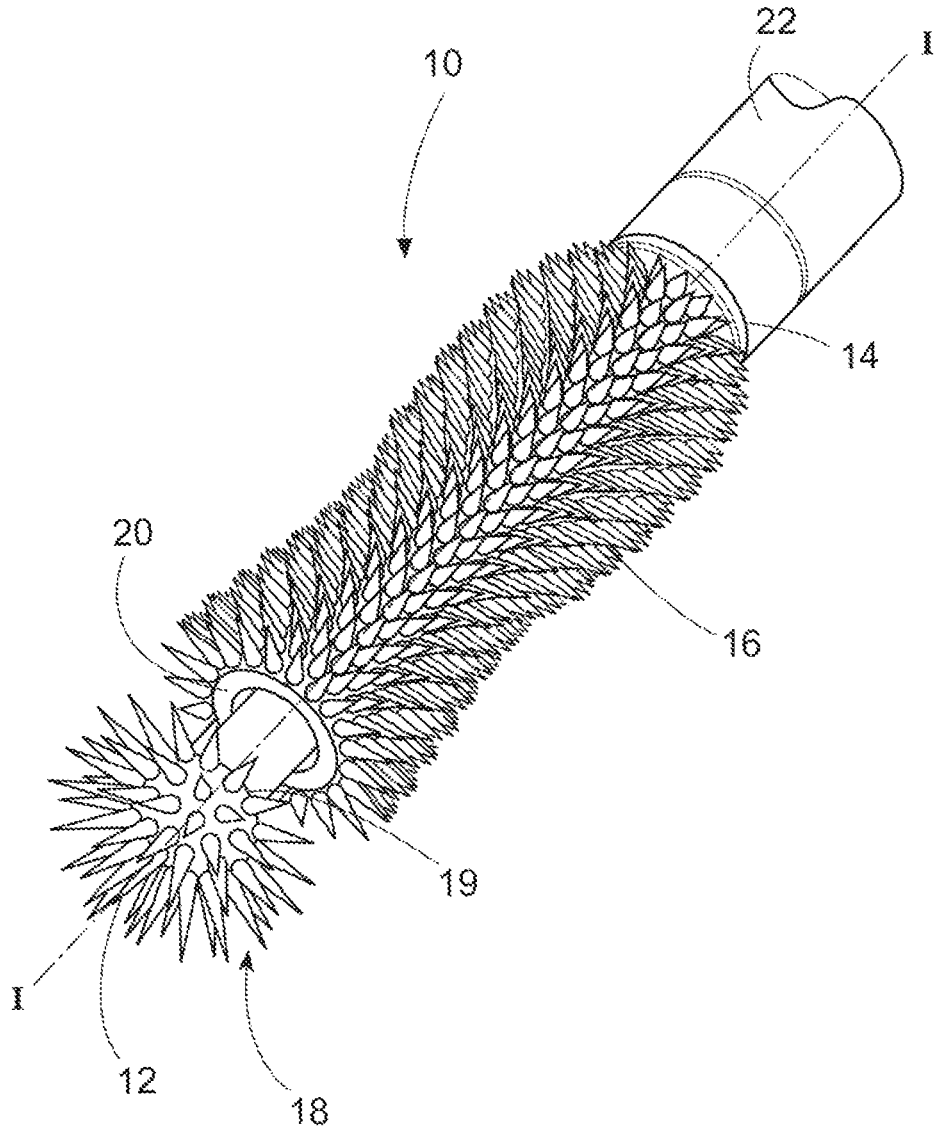
FIG. 4 shows an exemplary embodiment of the grooming device according to the present invention having a portion encompassing the terminal distal end of the grooming element that is capable of independently moving along the longitudinal axis.

FIG. 4 shows an exemplary embodiment of the grooming device according to the present invention having a second portion 18 that encompasses the distal end 12 of the grooming element 10. In this particular embodiment, the grooming element 10 has a substantially lemniscoid shape, including for example, a peanut shape. The grooming element 10 includes a first portion 16 and a second portion 18 that encompasses the distal end 12 of the grooming element 10. The second portion 18 is coaxial with the first portion 16 and capable of moving along the longitudinal axis I-I independently from the first portion 16. The second portion 18 may be fitted with the first portion 16 to form a uniform and continuous curvilinear shape, specifically the lemniscoid shape (e.g., peanut shape). In some embodiments, the distal end 12 of the grooming element 10 may be rounded to form a curved shape. Preferably, the second portion 18 of the grooming element 10 has a substantially hemispherical shape.

Figure 5:
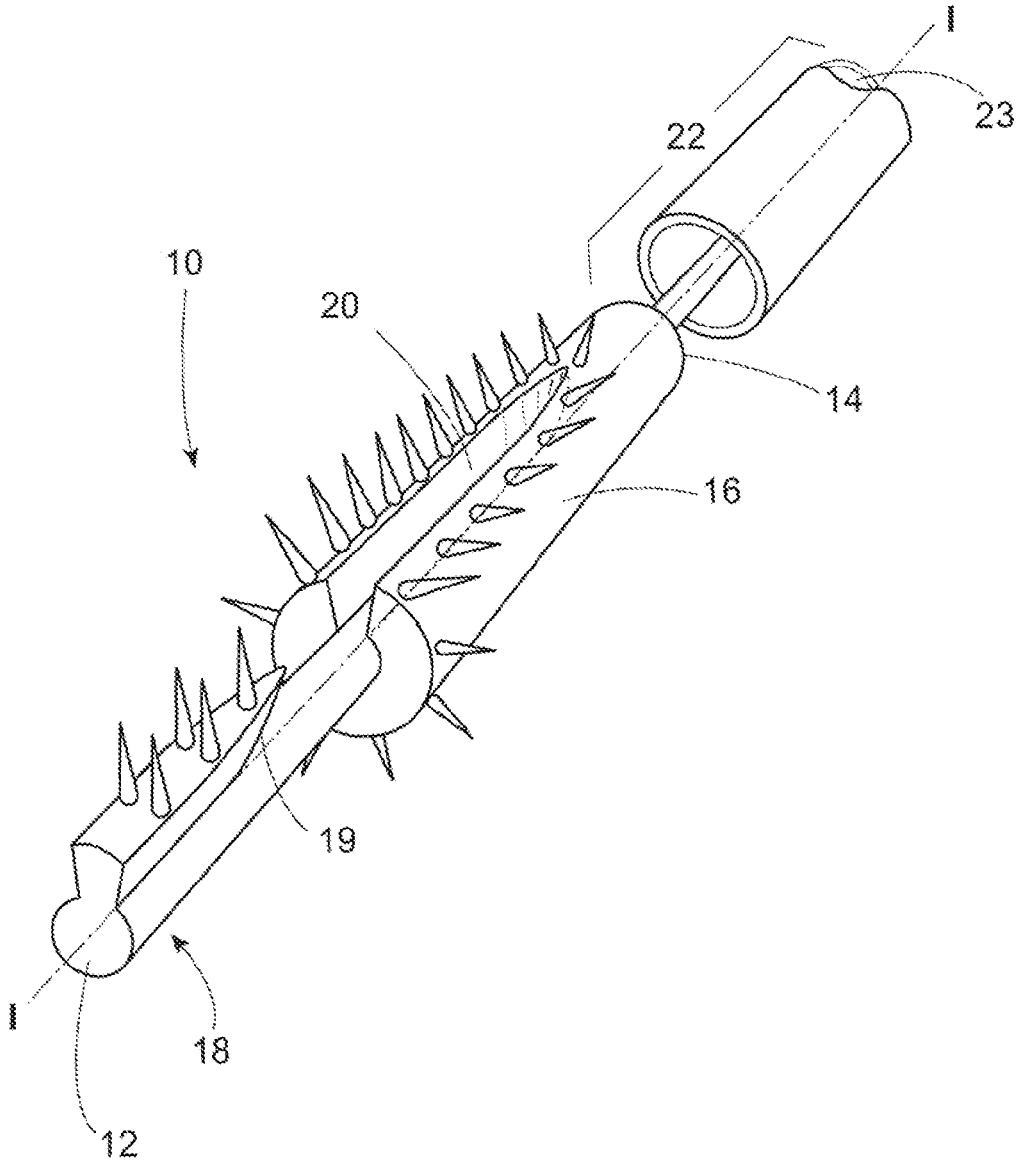
FIG. 5 shows an exemplary embodiment of the grooming device according to the present invention having a portion along a longitudinal axis and has a width extending from an exterior surface to the longitudinal axis that is capable of independently moving along the longitudinal axis, and a beveled cut-away that is capable for eliminating excess hair care composition from the surfaces of said movable portion.

FIG. 5 shows another exemplary embodiment of the grooming device according to the present invention. Similar to the embodiment shown in FIG. 1, the grooming element 10 as shown in FIG. 5 has a substantially cylindrical shape, but instead has a flat distal end 12. The grooming element 10 shown in FIG. 5 has a first portion 16 having a cut-away 20 parallel to the longitudinal axis I-I and along a cross-sectional radius of the grooming element 10. The second portion 18 of the grooming element 10 lies along the longitudinal axis I-I and may be fitted into the cut-away 20 to form a uniform and continuous curvilinear shape with the first portion 16 of the grooming element 10. Preferably, as shown in FIG. 5, the cut-away 20 may have a beveled shape for eliminating excess hair care composition from the surfaces 19 of the second portion 18 of the grooming element 10. In particular, the cut-away 20 may be wide at the surface of the grooming element 10 and become tapered towards the longitudinal axis I-I of the grooming element 10. The cut-away 20 may also have a further tapered and/or beveled shape at the proximal end thereof to further eliminate excess hair care composition from the surfaces 19 of the second portion 18. Removal of excess hair care composition from the surfaces 19 of the second portion 18 of the grooming element 10 should reduce the amount build-up of hair care composition from regular use between the first portion 16 and the second portion 18 of the grooming element 10 and therefore improve and/or maintain the ability of the second portion 18 to move along the longitudinal axis I-I.

The first portion 16 and/or the second portion 18 of the grooming element 10, include means for holding and releasing a hair care composition, such as a hair dye and can include any type of surface for holding a charge of hair care composition and transferring it to an integument or the hair of the scalp or any other part of the body on contact therewith. Specifically, the surface may transfer a hair care composition to a keratin fiber, e.g., hair of the scalp on contact. Any suitable surfaces (e.g., textured or smooth) capable of holding and transferring a charge of hair care composition may be included in the first portion 16 and/or the section portion 18 of the grooming element 10. The surfaces may also be capable of imparting various types of aesthetically pleasing appearances to the keratin fibers, e.g., hair of the scalp, such as a volumized appearance, a separated appearance (i.e., the fibers being individually separated from each other), a curly appearance, etc. Examples of suitable textured surfaces include bristles, projections, indentations, fins, tines, velcro, teeth, grooves, sponges, foam or flocked surfaces. The surfaces may be formed from any suitable substance. In some embodiments, the surfaces are formed from silicone or other soft touch materials.

In a preferred embodiment, the textured surface is composed of a plurality of bristles extending from the surface of the first portion 16 and/or the second portion 18 of the grooming element 10. For example, the grooming element 10 may comprise a core having an elongated shape, e.g., a substantially cylindrical, rectangular, obloid, conical, spherical, prismatic, or lemniscoid (e.g., peanut-shaped) shape. The core may comprise any material suitable for holding a textured surface. In some exemplary embodiments, the core may comprise twisted wires having bristles contained within. In certain embodiments, the bristles may be fastened to the core in any manner known in the art including staple set, fuse, adhesive or molding methods. In an exemplary embodiment, the bristles may extend radially randomly, or otherwise, from the core. In other exemplary embodiments, the bristles may extend normal to the core. In some embodiments, the bristles are located at the distal end 12 of the grooming element 10, along a perimeter about the longitudinal axis I-I of the elongated grooming element 10, or a combination there of. In certain embodiments, the bristles are located solely at the distal end 12 of the grooming element 10. In other embodiments, the bristles are located solely along a perimeter about the longitudinal axis I-I of the elongated grooming element 10. Bristles according to one embodiment of the invention will typically be less than 100 mm in length, less than 50 mm in length, less than 30 mm in length, less than 25 mm in length, less than 20 mm in length, less than 10 mm in length, less than 5 mm in length. The bristles may be formed so that some or all of the bristles have a varying diameter, length, or cross-sectional shape. For example, some bristles may have one diameter, length, and/or shape and other bristles will have another diameter, length and/or shape. Also, the cross-sectional shape or diameter of individual bristles may change along their length. The bristles may be, without limitation, integral with the first portion 16 and/or the second portion 18 of the grooming element 10 or may be synthetic fibers or natural fibers implanted therein.

In one preferred embodiment, the texture surface may comprise an array of stub-like projection, fin-like projections, and/or bristles arranged in any suitable shape or pattern and need not be symmetrical. Examples of suitable patterns include spaced and parallel rows, staggered rows and columns, linear rows and columns, or random patterns. The density of the array may vary depending on the characteristics of the hair care composition being applied. Differences in the densities of the array of projections may also impart different aesthetic looks to the keratin fibers.

Figure 6:
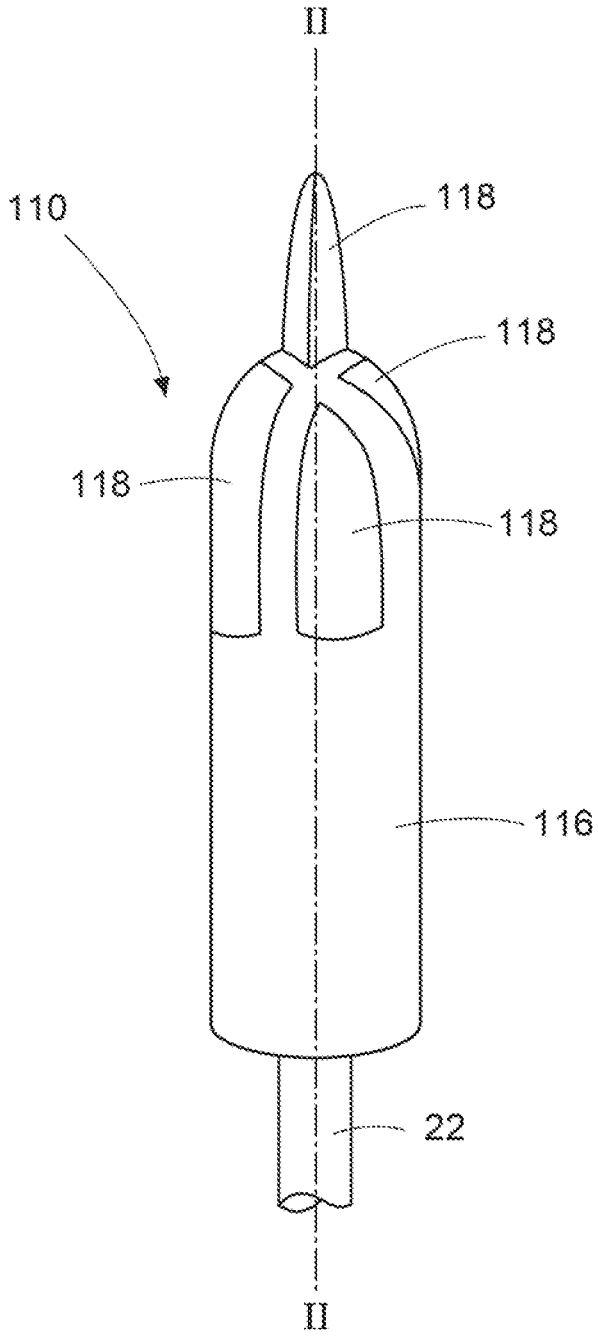
FIG. 6 shows an exemplary embodiment of the grooming device according to the present invention having a plurality of portions capable of independently moving along the longitudinal axis.

In other embodiments of the grooming device according to the present invention, as shown in FIG. 6, the grooming element 110 may have a plurality of portions that move independently along the longitudinal axis II-II. Specifically, the grooming element 110 may have a fixed portion 116 attached to a handle 22, such that the fixed portion 116 cannot move in a longitudinal direction with respect to said handle 22, and a plurality of movable portions 118 separable from the fixed portion 116 that is capable of moving along the longitudinal axis II-II of the grooming element 110, independent from the fixed portion 116 or from other movable portions 118. The grooming element 110 may comprise at least 1, at least 2, at least 3, at least 4, at least 5, at least 6, at least 7, at least 8, at least 9 or at least 10 movable portions 118. In some embodiments, at least two, or at least three or more, of the movable portions 118 can move together, in concert or otherwise, and in the same or different directions, with respect to the fixed portion 116. The fixed portion 116 and/or each of the plurality of movable portions 118 may include means for holding and releasing a hair care composition, such as a hair dye, and can include any type of textured surface for holding a charge of hair care composition and transferring it to an integument on contact therewith. Specifically, the fixed portion 116 and each of the plurality of movable portions 118 may each independently impart a beneficial functionality to improve application of a hair care composition and/or a grooming effect. For example, the fixed portion 116 and each of the plurality of movable portions 118 may each independently select from any type of textured surface for holding a charge of hair care composition and transferring it to an integument on contact therewith, such as, for example, of bristles, projections, indentations, fins, tines, velcro, teeth, grooves, sponges, foam, flocked surfaces, and smooth surfaces. The textured surfaces may be formed from any suitable substance. In some embodiments, the textured surfaces are formed from silicone or other soft touch materials. In other embodiments, the movable portion 118 may have no texture, for example a smooth surface, as would be the case for a spatula-type implement, for example.

Figure 7A:
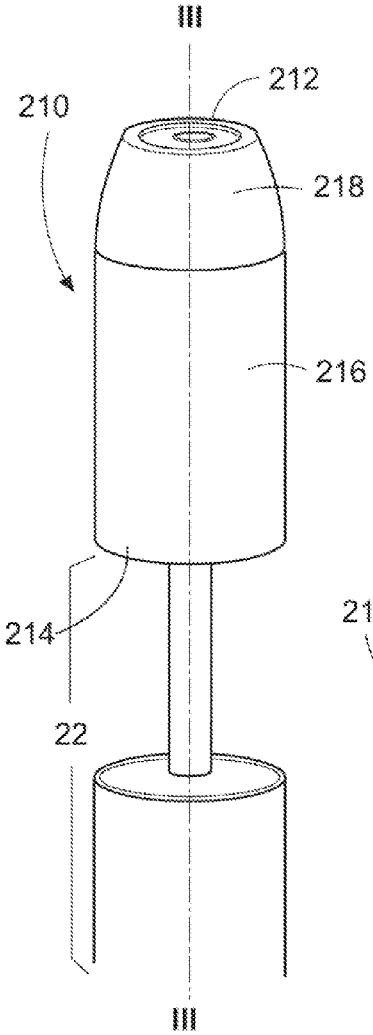
FIGS. 7A, 7B and 7C shows three different configurations of an exemplary embodiment of the grooming device according to the present invention having a first portion, a second portion, and a third portion, each of which may move independently from the other portions along the longitudinal axis.
Figure 7B:
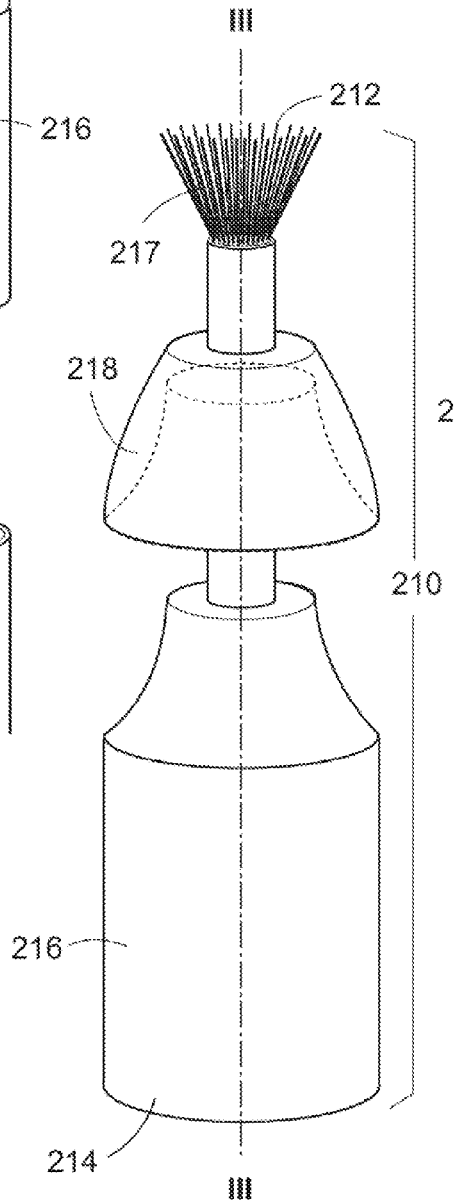
Figure 7C:
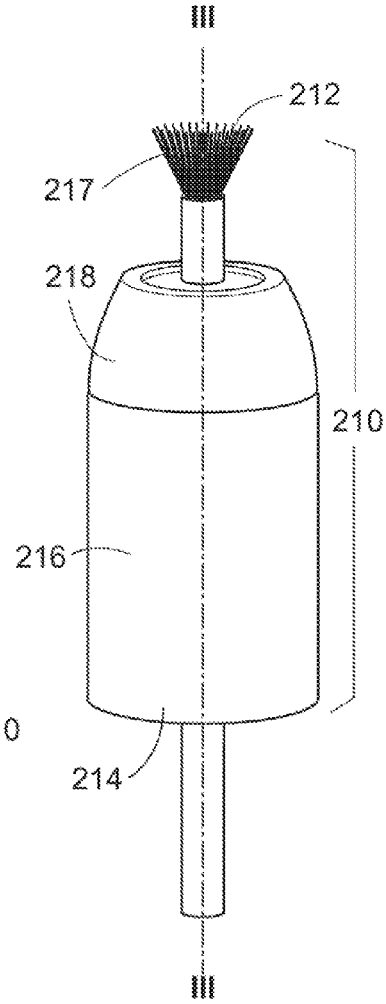

In another alternative embodiment, the grooming device according to the present invention, as shown in three different arrangements in FIGS. 7A, 7B and 7C, comprises a grooming device 210 having a proximal end 214 and a distal end 212. The grooming device 210 may comprise a first portion 216, a second portion 218, and a third portion 217, each of which may move independently from the other portions along the longitudinal axis III-III. The grooming device 210 includes a first portion 216 elongated along the longitudinal axis III-III and having a distal end 212 and a proximal end 214 and a second portion 218 coaxial with and separable from the first portion 216. The first portion 216 and the second 218 portion, when fitted together (FIGS. 7A and 7C) provide a substantially uniform shape, particularly a substantially cylindrical shape, and define an elongated lumen therein. The third portion 217 may also have an elongated shape and may be coaxial with the first and second portions 216, 218. Specifically, the lumen of the first and second portions 216, 218 may be capable of receiving at least a portion of the third portion 217 therein. For example, the third portion 217 may be capable of extending away from the first and second portions 216, 218 in a distal direction and also capable of retracting to partially, but not completely, fit within the lumen by moving along the longitudinal axis III-III in a proximal direction. Alternatively, the third portion 217 may be capable of retracting completely within the lumen. In a preferred embodiment, the first and second portions 216, 218 may provide a full or partial sheath over the third portion 217 in a fully retracted configuration. In another embodiment, the third portion 217 is in contact with at least one outer surface of the first portion 216 or the second portion 218 when the third portion 217 is in a fully retracted configuration.

The third portion 217 may comprise, for example, a brush, a comb, a sponge applicator, a foam applicator, and the like, that either fit completely within the lumen, or that do not completely fit within the lumen of the first and second portions 216, 218. Preferably, the third portion 217 is a brush or a comb, which retracts into the first portion 216 or the second portion 218 when the third portion 217 is in a fully retracted configuration, as shown in FIG. 7A. In some embodiments, the third portion 217 may be suitably shaped to be in contact with at least one outer surface of the first portion 216 or the second portion 218 when the third portion 217 is in a fully retracted configuration.

In another alternative embodiment, the grooming device according to the present invention, comprises at least two grooming elements that move independently along the longitudinal axis. The grooming devise includes a first grooming element elongated along the longitudinal axis and having a proximal end and a distal end; and a second grooming element capable of moving independently from the first grooming element along the longitudinal axis. Preferably, the first grooming element is coaxial with the second grooming element about the longitudinal axis. The first grooming element may define a lumen therein for receiving a second grooming element. Specifically, the first grooming element may include a substantially cylindrical lumen therein along the longitudinal axis for receiving the second grooming element. For example, the second grooming element may be capable of extending away from the first grooming element in a distal direction and also capable of retracting in a proximal direction to partially, but not completely, fit within the lumen, or may completely fit within the lumen, of the first grooming element. In a preferred embodiment, the first grooming element may provide a partial sheath over the second grooming element in a fully retracted configuration. In another embodiment, the second grooming element is in contact with at least one outer surface of the first grooming element when the second grooming element is in a fully retracted position.

The second grooming element may also have an elongated shape along the longitudinal axis. The second grooming element may comprise any elongated hair grooming devices that are suitably shaped to be in contact with at least one outer surface of the first grooming element when the second grooming element is in a fully retracted position. Suitable examples for a second grooming element include, for example, a brush, a comb, a sponge applicator, a foam applicator, and the like, that do not completely fit within the lumen of the first grooming element. Preferably, the second grooming element is a brush or a comb, suitably shaped to be in contact with at least one outer surface of the first grooming element when the second grooming element is in a fully retracted position.

The grooming device of the present invention may be placed in a kit with or used in combination with a container 30 charged with a hair care composition, which can include a variety of hair care and personal care products to keratin fibers or to the skin, including without limitation, hair dye, hair gel, mousse, conditioner, hair serum, etc. In some embodiments, the hair care composition is a liquid, viscous liquid, semi-solid or solid hair care composition. Preferably, the hair care composition is a hair dye. More preferably, the hair care composition for the hair of the scalp, including without limitation, pigmented hair colorants, hair dyes, pharmaceutically and/or cosmeceutically active hair care compositions, or a combination thereof.

Figure 8:
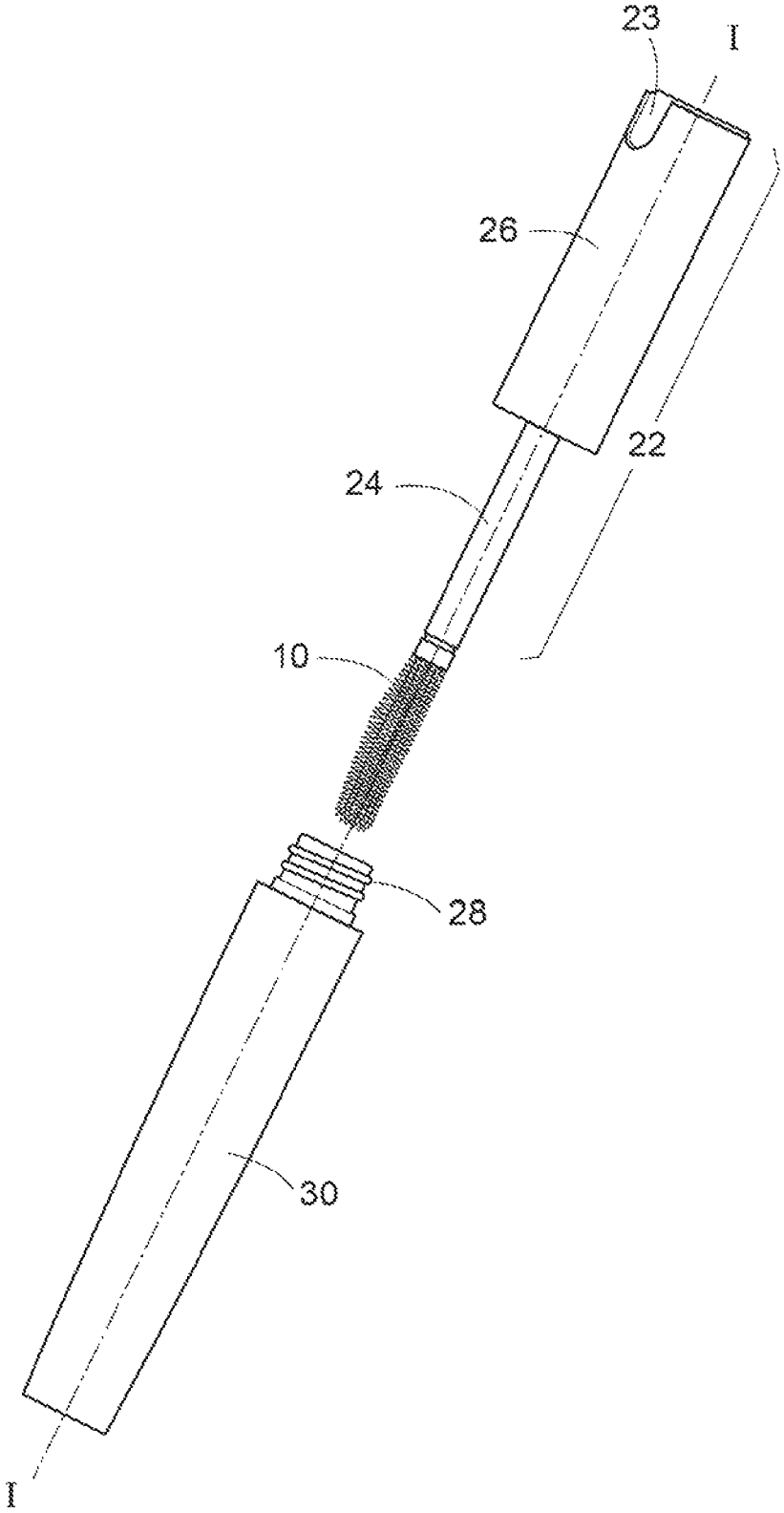
FIG. 8 shows an exemplary embodiment of a hair care product comprising the grooming device according to the present invention.

In the particular embodiment shown in FIG. 8, the grooming element 10 is attached to a handle 22, which encompasses a cap 26 capable of being reversibly secured to a container 30 and a rod 24 secured to the cap 26 at a proximal end thereof and secured to the grooming element 10 at the other end thereof. The rod may be of any shape, for example, it may have a circular, U-shaped, rectangular, oblong, or any geometrically shaped cross-section, and it may be narrower, wider, or equal in width to the cap. The rod 24 may be secured to a first portion (not shown) of the grooming element 10 and allowing a second portion (not shown) of the grooming element 10 to independently move from the rod 24 along the longitudinal axis I-I. Alternatively, the rod 24 may be secured to the second portion of the grooming element 10 and allowing the first portion of the grooming element 10 to independently move from the rod 24 along the longitudinal axis I-I. In related embodiments, the cap may be omitted entirely, the device may include any type of handle, and the opening of the container may be closed by the device itself, for example, by complementary threads on the body or handle of the device and the opening of the container. The device can be equipped with a trip mechanism, such that when it is inserted, and/or removed, from the container the first and second portion of the applicator element are automatically extended or retracted. The container may also include a means for wiping excess composition from the grooming element as the device is removed from the container.

Preferably the kit, including the grooming element 10, the handle 22, the cap 26 and the container 30, may be made from plastic, metal, and/or thermoplastic elastomers, rubber, manufactured using injection and/or injection blow molding, and assembled by snap-fit assembly. However, it is contemplated that any other material, manufacturing, and/or assembly method may also be used. In particular, the cap 26 and the container 30 may be made with anodized plastic materials to provide a metallic look.

The invention described and claimed herein is not to be limited in scope by the specific embodiments herein disclosed since these embodiments are intended as illustrations of several aspects of this invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All publications cited herein are incorporated by reference in their entirety.

What is claimed:

1. A grooming device comprising:

a grooming element comprising a first portion having an outer surface and a second portion having an outer surface, wherein the outer surfaces of said first and second portions are separatable from one another and capable of moving independently from one another from a fully retracted position to an extended position;

wherein said first portion comprises a cut-away therein suitably shaped to receive said second portion;

wherein said second portion comprises at least a portion of the terminal end of said grooming element when said second portion is fully retracted;

wherein said first and second portions together form a substantially uniform cross-sectional profile of said grooming element; and wherein a handle portion is fixed to said first portion of said grooming element, such that said first portion cannot move in a longitudinal direction with respect to said handle.

2. The device according to claim 1, wherein said grooming element is elongated along a longitudinal axis.

3. The device according to claim 1 wherein said first portion is capable of moving independently from said second portions along a longitudinal axis.

4. The device according to claim 1, wherein said grooming element has a substantially cylindrical, rectangular, obloid, conical, spherical, prismatic, or lemniscoid shape.

5. The device according to claim 1, wherein said first and/or second portions of said grooming element comprise a textured surface for engaging keratin fibers or for improving the aesthetic appearance of keratin fibers.

6. The device according to claim 5, wherein said first and/or second portions of said grooming element comprise said textured surface is capable of holding a charge of a hair care composition and transferring it to keratin fibers on contact therewith.

7. The device according to claim 6 wherein said textured surface is independently selected from the group consisting of bristles, projections, indentations, fins, tines, velcro, teeth, grooves, sponges, foam, flocked surfaces, and smooth surfaces.

8. The device according to claim 7, wherein said first portion of said grooming element comprises a textured surface composed of a plurality of bristles from the surface of said grooming element.

9. The device according to claim 1, wherein said handle portion is capable of being reversibly secured to a container of hair care composition.

10. The device according to claim 1, further comprising:

an actuating mechanism disposed on or in said handle portion for moving said second portion along said longitudinal axis.

11. The device according to claim 1, wherein said second portion of said grooming element comprises the terminal end of said grooming element.

12. The device according to claim 1, wherein said second portion of said grooming element is coaxial with said first portion of said grooming element.

13. A grooming device comprising:

a grooming element comprising a first portion having an outer surface and a second portion having an outer surface, wherein the outer surfaces of said first and second portions are separatable from one another and capable of moving independently from one another from a fully retracted position to an extended position;

wherein said first portion comprises a cut-away therein suitably shaped to receive said second portion;

wherein said second portion comprises at least a portion of the terminal end of said grooming element when said second portion is fully retracted;

wherein said first and second portions together form a substantially uniform cross-sectional profile of said grooming element;

wherein a handle portion is fixed to said second portion of said grooming element, such that said second portion cannot move in a longitudinal direction with respect to said handle; and wherein said handle portion is capable of being reversibly secured to a container of hair care composition.

14. A grooming device comprising:

a grooming element comprising a first portion having an outer surface and a second portion having an outer surface, wherein the outer surfaces of said first and second portions are separatable from one another and capable of moving independently from one another from a fully retracted position to an extended position;

wherein said first portion comprises a cut-away therein suitably shaped to receive said second portion;

wherein said second portion comprises at least a portion of the terminal end of said grooming element when said second portion is fully retracted;

wherein said first and second portions together form a substantially uniform cross-sectional profile of said grooming element;

wherein a handle portion is fixed to said first portion of said grooming element, such that said first portion cannot move in a longitudinal direction with respect to said handle; and wherein an actuating mechanism is disposed on or in said handle portion for moving said second portion along said longitudinal axis.

15. A grooming device comprising:

a first grooming element elongated along a longitudinal axis, said first grooming element having an outer surface, and a second grooming element disposed within and coaxial to said first grooming element, said second grooming element having an outer surface, wherein the outer surfaces of said first and second grooming elements are separatable from one another and, capable of moving independently from said one another from a fully retracted position to an extended position along said longitudinal axis;

wherein said first grooming element comprises a cut-away therein suitably shaped to receive said second grooming element;

wherein said second grooming element comprises at least a portion of the terminal end of said grooming device when said second grooming element is fully retracted; and wherein said first and second grooming elements together form a substantially uniform cross-sectional profile of said grooming device;

wherein a handle portion is fixed to said first portion of said grooming element, such that said first portion cannot move in a longitudinal direction with respect to said handle; and wherein an actuating mechanism is disposed on or in said handle portion for moving said second portion along said longitudinal axis.

16. The device according to claim 15, wherein said second grooming element comprises a comb or a brush, which is in contact with at least one outer surface of said first grooming element when said second grooming element is in a fully retracted position.

* * * * *